US010178468B2

(12) United States Patent
Bay et al.

(10) Patent No.: US 10,178,468 B2
(45) Date of Patent: Jan. 8, 2019

(54) ACOUSTIC SYSTEM HAVING A HOUSING WITH ADSORBENT POWDER

(71) Applicant: Fraunhofer-Gesellschaft zur Förderung der angewandten Forschung e.V., Munich (DE)

(72) Inventors: Karlheinz Bay, Stuttgart (DE); Michael Leistner, Stuttgart (DE); Philip Leistner, Stuttgart (DE); Waldemar Maysenhölder, Stuttgart (DE)

(73) Assignee: FRAUNHOFER-GESELLSCHAFT ZUR FÖRDERUNG DER ANGEWANDTEN FORSCHUNG E.V., Munich (DE)

( * ) Notice: Subject to any disclaimer, the term of this patent is extended or adjusted under 35 U.S.C. 154(b) by 54 days.

(21) Appl. No.: 14/895,978

(22) PCT Filed: Jun. 6, 2014

(86) PCT No.: PCT/EP2014/061872
§ 371 (c)(1),
(2) Date: Dec. 4, 2015

(87) PCT Pub. No.: WO2014/195476
PCT Pub. Date: Dec. 11, 2014

(65) Prior Publication Data

US 2016/0127821 A1 May 5, 2016

(30) Foreign Application Priority Data

Jun. 7, 2013 (DE) ..... 10 2013 210 696

(51) Int. Cl.
*H04R 1/20* (2006.01)
*H04R 1/28* (2006.01)
(Continued)

(52) U.S. Cl.
CPC ..... *H04R 1/2807* (2013.01); *H04R 1/28* (2013.01); *H04R 1/2803* (2013.01); *H04R 1/288* (2013.01);
(Continued)

(58) Field of Classification Search
CPC ..... H04R 1/2807; H04R 1/28; H04R 1/2803; H04R 1/288; H04R 1/2888; H04R 29/001; H04R 21/02
(Continued)

(56) References Cited

U.S. PATENT DOCUMENTS 1,711,410 A 4/1929 Graham et al.
4,657,108 A 4/1987 Ward
(Continued)

FOREIGN PATENT DOCUMENTS

DE 197 46 645 C1 5/1999
EP 1 868 410 A1 3/2006
(Continued)

OTHER PUBLICATIONS

International Preliminary Report on Patentability, dated Dec. 17, 2015, pp. 1-9, International Application No. PCT/EP2014/061872, The International Bureau of WIPO, Geneva, Switzerland.
(Continued)

*Primary Examiner* — Sean H Nguyen
(74) *Attorney, Agent, or Firm* — Brinks Gilson & Lione

(57) ABSTRACT

An acoustic system is provided that includes a transducer having a housing, which encloses a volume and in which at least a surface or a sub-surface is formed by a sheet-like structure configured to vibrate. Powder made of adsorbent material having an adsorption effective surface may be present in the volume. The powder may be selected such that, through a movement of the powder caused by vibrations of the sheet-like structure configured to vibrate, the
(Continued)

adsorption effective surface is enlarged. The adsorbent material may be selected such that an adsorption of air or gas present in the volume is caused by an increase of the pressure caused from vibrations of the sheet-like structure configured to vibrate. The powder is freely movable within the housing.

16 Claims, 2 Drawing Sheets

(51) Int. Cl.
*H04R 29/00* (2006.01)
*H04R 21/02* (2006.01)

(52) U.S. Cl.
CPC ..... *H04R 1/2888* (2013.01); *H04R 29/001* (2013.01); *H04R 21/02* (2013.01)

(58) Field of Classification Search
USPC ..... 381/353
See application file for complete search history.

(56) References Cited

U.S. PATENT DOCUMENTS

| | | | | |
|---|---|---|---|---|
| 2004/0251077 | A1 | 12/2004 | Wright et al. | |
| 2007/0147645 | A1* | 6/2007 | Kuze | H04R 1/2819 381/337 |
| 2007/0165895 | A1* | 7/2007 | Matsumura | H04R 1/2803 381/351 |
| 2009/0028370 | A1* | 1/2009 | Matsumura | H04R 1/2803 381/386 |
| 2009/0245562 | A1* | 10/2009 | Saiki | H04R 1/2803 381/345 |
| 2010/0074463 | A1* | 3/2010 | Fukunishi | H04R 1/2803 381/386 |
| 2010/0329494 | A1 | 12/2010 | Rouvala et al. | |
| 2012/0114163 | A1* | 5/2012 | Yang | H01Q 1/44 381/386 |
| 2013/0308812 | A1* | 11/2013 | Shen | H04R 1/288 381/346 |

FOREIGN PATENT DOCUMENTS

| | | | |
|---|---|---|---|
| EP | 1 786 231 | A1 | 5/2007 |
| EP | 1 786 235 | A1 | 5/2007 |
| EP | 1 868 410 | A1 | 12/2007 |
| EP | 2 003 924 | A1 | 12/2008 |
| EP | 2 154 906 | A1 | 2/2010 |
| WO | WO 99/21395 | | 4/1999 |

OTHER PUBLICATIONS

International Search Report with English translation, dated Sep. 29, 2014, pp. 1-7, issued in International Application No. PCT/EP2014/061872, European Patent Office, Rijswijk, The Netherlands.

"Absorption (chemistry)," German entry with corresponding English entry, dated Jun. 4, 2013, pp. 1-5, retrieved from Wikipedia on Apr. 29, 2014, at URL: https://de.wikipedia.org/wiki/Absorption_(Chemie).

"Kundt's Tube," German entry with corresponding English entry, dated Jun. 5, 2013, pp. 1-9, retrieved from Wikipedia on Apr. 29, 2014, at URL: https://de.wikipedia.org/wiki/Kundtsches_Staubrohr.

"Lycopodium," German entry with corresponding English entry, dated Apr. 2, 2013, retrieved from Wikipedia on Apr. 29, 2014, at URL: https://de.wikipedia.org/wiki/B%C3%A4rlappsporen.

* cited by examiner

ACOUSTIC SYSTEM HAVING A HOUSING WITH ADSORBENT POWDER

CROSS-REFERENCE TO RELATED APPLICATIONS

This application is a 371 nationalization of PCT/EP2014/061872, entitled "ACOUSTIC SYSTEM HAVING A HOUSING WITH ADSORBENT POWDER," having an international filing date of Jun. 6, 2014, the entire contents of which are hereby incorporated by reference, which in turn claims priority under 35 USC § 119 to German patent application DE 10 2013 210 696.3 filed on Jun. 7, 2013, entitled "Akustisches System mit einem Gehäuse mit adsorbierendem Pulver," the entire contents of which are hereby incorporated by reference.

BACKGROUND

The application relates to an acoustic system having a housing with adsorbent powder.

In acoustic systems having hollow spaces, such as, for example, loudspeaker housings, the compliance of the mostly air-filled hollow space, volume determines their effect at low frequencies, regardless of whether they are sound-generating or sound-attenuating systems. It holds that the greater the volume, the greater the acoustic compliance and the greater the acoustic efficiency. Manipulation is therefore required in order to increase the acoustic compliance of small hollow spaces when space is limited. Attempts at achieving this have led, among other things, to filling the housing with absorbent or adsorbent materials. Known porous materials have shown to be applicable here, since absorption is, simply put, a volume effect. The effect with reference to the magnification of the acoustic compliance is, however, limited in theory as well as in practice, above all because the volume represents precisely the critical magnitude. Adsorption, on the other hand, is a surface effect that theoretically can be extremely increased, as long as the effective surface can be increased regardless of volume. Effects were obtained with different adsorbers in different material form, for example, U.S. Pat. No. 4,657,108 and US 2004/0251077, which holds out the prospect of a doubling of the acoustic compliance. It is in practical terms for the most part active carbon, which is used as a coating for moldings or in granular form in the housing, as shown in FIG. 1, which will be described in more detail later. Active carbon is comparatively inexpensive and easy to obtain. However, it also has to disadvantages for this specific application: one of which is vulnerability to air humidity. The technical embodiments for housings filled with active carbon, in particular loudspeakers, are therefore concentrated on the protection from and the prevention of humidity in housings. Additives, such as substances with, in turn, absorbing or hydrophilic is properties, are proposed on the one hand to bind the humidity (US 2004/0251077). Additional barriers or packings in the housing are described, which on the other hand are to keep humidity away from the active carbon (U.S. Pat. No. 4,657,108). Since these barriers, for example, films or high-density fleeces, however also have an acoustic effect, partial compromises must be accepted. Pressure equalization tubes, which however can again contain active carbon to preclude the penetration of humidity, are provided in order to prevent, for example, a pressure difference between the housing and the active carbon packed in the film (U.S. Pat. No. 4,657,108).

An easy way to solve the problem of penetrating humidity is represented by a moisture-tight housing with a likewise tight loudspeaker and a tight connection between the housing and the loudspeaker. This configuration has remained unacknowledged so far for unknown reasons. A presumed reason is represented by the preferred use of electrodynamic conical loudspeakers. Waterproofing is not readily possible for the intended use. A problem is created at the same time if granular active carbon or powdered active carbon is used, since it can obstruct the open annular gap within which the oscillator coil moves. This results in another reason for the described protective measures with regard to active carbon in the housing.

Aside from these use-related configuration aspects, the question arises of whether the acoustic compliance can be further increased. A grain size of between 0.1 and 0.3 mm (U.S. Pat. No. 4,657,108) is preferred with reference to the surface effect adsorption and the previously known doubling through active carbon granulate. Active carbon in still finer disintegration (approx. 0.05 mm) is indeed proposed in the already mentioned pressure equalization tubes (U.S. Pat. No. 4,657,108), but with the express function of a moisture barrier. Further attempts or research with other modes of administration of active carbon are not known.

A loudspeaker arrangement is known from EP 1 868 410 A1. A housing is present therein. A housing wall is formed in part by a membrane. A drive, which stimulates the membrane to vibrate, is located inside the housing. There is furthermore an area within the housing, in which the powdered active carbon is arranged. The active carbon is accommodated in a sleeve, for example, a bag. In this way the active carbon is above all prevented from moving freely within the housing and damaging the drive that stimulates the membrane to vibrate. It should be noted in this connection that such drives are mostly coils with an annular gap. The drive can be damaged if the fine powdered active carbon reaches there.

It is generally known that active carbon can adsorb gas, depending on the pressure. It is occasionally erroneously addressed as absorption, for example, in the description in Wikipedia (status as of Jun. 4, 2013).

Kundt's tube is likewise described in Wikipedia. With Kundt's tube it is possible to make standing waves visible in a glass tube. Clubmoss spores, for example, are moved by the intensive sound wave and collect at the points at which the particle velocity of the sound waves is lowest, that is, in the nodes of the standing wave. The clubmoss spores are moved by the sound waves.

Starting from the previously determined potential of an active carbon filling in a housing for the purpose of increasing the acoustic compliance and the practical problems simultaneously connected therewith, the object is to reinforce the acoustic effect as well as to reduce or eliminate the practical problems.

DETAILED DESCRIPTION

Figure 1:
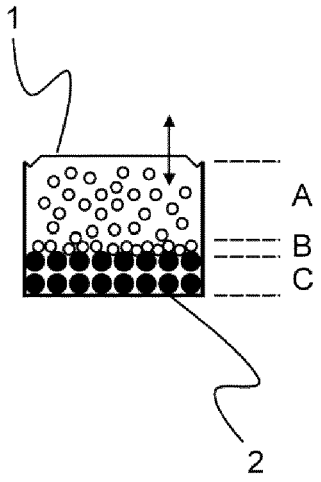
FIG. 1 shows a simplified schematic representation of a membrane of a sound transducer.

It was determined that an acoustic system, in particular a sound transducer, is to be made available, with a housing, which encloses a volume and in which at least a surface or a partial surface is formed by a sheet-like structure configured to vibrate, wherein powder made of adsorbent material having an adsorption effective surface is present in the volume, wherein the powder is selected such that a movement of the powder takes place within the volume as a result of the vibrations of the sheet-like structure configured to vibrate.

The movement has to take place in such a way that an adsorption-effective surface is selected in such a way that an adsorption of the air or gas present in the volume takes place with an increase of the pressure as a result of vibrations of the sheet-like structure configured to vibrate.

As was mentioned initially, it is known that the stiffness can be reduced by means of adsorbent substances in the volume of a sound transducer, since the available volume can thereby likewise be increased. It is clear, at the same time, that the available surface plays a decisive role in addition to the selection of the suitable material—an adsorption must take place with the pressure increase. Active carbon is therefore frequently selected, since active carbon has the desired adsorption properties and exhibits a high surface.

Experiments with active carbon have shown that a clear increase of the adsorption takes place with a grain size of the powder of clearly less than 0.1 mm. A specific increase can be explained, since the surface available for adsorption increases with decreasing grain size. The observed increase can however not be sufficiently explained therewith.

The pronounced increase can only be explained in that the vibrations of the sheet-like structure configured to vibrate elicit a movement of the powder particles with sufficiently small particle size, whereby the adsorption effective surface is clearly enlarged. This movement leads to an increase of the distance of the powder particles, such that the air or the gas that is to be adsorbed can better reach the powder particles. The density of the filling is increased as a result of the distance change, since the same amount of powder particles takes up a greater amount of space. The pressure fluctuations therefore cause a dynamic density change. A swirling of the powder is frequently also connected therewith. It is however not necessary for the powder to be present in the housing. It is sufficient for the most part that the distance of the powder particles with respect to each other increases as a result of the movement.

From this analysis follows the important conclusion that the powder made of adsorbent material for reduction of the stiffness of the sound transducer is to be selected in such a way that a movement of the to powder is elicited by the vibrations of the sheet-like structure configured to vibrate. This is not limited to active carbon powder with the mentioned grain size.

The powder furthermore moves freely within the housing. This goes beyond the mentioned swirlability. To this is added that the powder is can be at different locations of the housing and not only in a specific area. For this reason, a separation of this area is omitted, such that the powder can be more easily swirled by the sound waves. The powder is distributed, as a rule, dependent upon gravity and thus dependent upon the position in which the sound transducer is installed in the housing. In comparison to the arrangement known from EP 1 868 410 A1, in which the powder is accommodated in bags, a clearly better swirlability could be achieved thereby, such that the stiffness of the sound transducer can be more efficiently reduced. In any case, the air can better reach the powder particles and be better adsorbed there. A sleeve around the powder furthermore cannot prevent sound penetration, so that expensive materials and of course the packing expenditure may increase the costs.

At the focal point of the invention are passive sound transducers, that is, sound transducers in which sound from outside, which is to be attenuated, stimulates into vibrating the sheet-like structure configured to vibrate. A drive that would have to be protected from the powder in the housing is not present in these cases. As will be shown later on, the invention can also be applied to acoustic systems in which a drive unit is present, with which the sheet-like structure that is configured to vibrate can be stimulated to vibrate.

As has become clear from the above description, active carbon is selected as adsorbent material in an embodiment of the invention.

It was likewise already explained that powder with a grain size of less than 0.1 mm is advantageous. At least a mass fraction of 50% of the powder with a grain size of less than 0.08 mm, preferably less than 0.05 mm, especially preferably less than 0.045 mm, should be present at the same time. It should be noted that the grain sizes are normally a result of a sifting. A specific distribution cannot be prevented with the is sifting. Individual particles with a grain size of almost 0.1 mm can thus be contained in a powder that is sifted with reference to a grain size of 0.05 mm.

With regard to the important material active carbon, it should be pointed out than it is generally called active carbon powder when a mass fraction of at least 50% has a grain size range of 0.045 mm. The mass percentage with a grain size range greater than 0.071 mm is at the same time lower than 25%.

Carbon nanotubes are selected as adsorbent material in an embodiment of the invention. Carbon nanotubes have sometimes displayed advantageous adsorption properties and are in the meantime easy to obtain. Silica gel or zeolite can also be used as adsorbent materials.

In one embodiment of the invention, the sheet-like structure that is configured to vibrate is a membrane, in particular a plastic membrane. Membranes, in particular plastic membranes, have proven to be reliable in sound transducers.

A drive unit, with which the sheet-like structure that is configured to vibrate can be stimulated to vibrate, is present outside of the housing in one embodiment of the invention. The function of the drive unit can be impaired by the powder present in the housing in expanded drive units located inside the housing. This can be prevented through an to installation outside of the housing.

A drive unit, with which the sheet-like structure that is configured to vibrate can be stimulated to vibrate is present in an embodiment of the invention, wherein the drive unit is immune from the powder present in the housing. Sheet-like structures comprised of multilayered films are is conceivable, for example, in which vibrations can be stimulated by applying an alternating voltage and corresponding electrostatic repulsions and attractions. Embodiments of the expanded drive units with coil and annular gap can also be obtained, in which the coil and annular gap are lined with a type of film that is also used, for example, to center the elements. This film-like structure can enclose the drive unit and a part of the sheet-like structure that is configured to vibrate in such a way that no powder can penetrate. The film-like structure can likewise be a part of the sheet-like structure that is configured to vibrate. It is understood that the arrangement of the drive unit outside of the housing also represents a drive unit that is immune from the powder present inside the housing.

The housing is moisture tight in an embodiment of the invention. Under moisture tight is to be understood that a wetting of the powder as a result of environmental humidity and a limitation of its adsorbent function can be prevented. It should be considered at this juncture to begin with that a wet material can generally limit the adsorption. Wet powder is additionally only very difficult to swirl. All told, it should be considered that adsorbent materials, such as, for instance, active carbon, are frequently hydrophilic.

More than half of the housing volume is filled with powder in an embodiment of the invention. Two requirements should be pondered when selecting the degree of filling. On the one hand, the highest possible air volume would be desirable, since a large volume can be more easily compressed. On the other hand, the highest possible degree of filling with powder should be sought in order to have as much adsorption material present as possible. It is practical to fill more than half of the volume of the housing with powder.

A microphone is in particular present in the housing of the sound is transducer in an embodiment of the invention. The sound pressure in the housing can be better registered therewith and the stimulation of the sheet-like structure that is configured to vibrate can be increased or decreased through a corresponding control unit depending on the sound pressure. This allows a further reduction of the stiffness, such that the reduction of the stiffness achieved by using powder made of adsorbent material can be further reinforced.

The sound pressure sensor must be suitably protected in order to prevent the powder from impairing its function.

It should be mentioned at this point that the invention can also be utilized well in an adaptive acoustic monitor, as described in DE 197 46 645 C1. If powder made of adsorbent material is added into the volume of the soundproof housing of DE 197 46 645 C1, then the soundproof housing can be configured smaller, but with the same acoustic properties.

In an embodiment of the invention, a sensor electrode is arranged in the housing in such a way that the arrangement of sensor electrode, powder made of adsorbent material and housing forms an electric circuit whose resistance can be changed through a density change of the powder, such that a statement about the sound that brings about a movement of the powder is possible through a measurement of the change of the resistance. This is above all because the particles of the powder are closer together with a high density of the powder and for this reason also have a higher contact surface. The current can flow better for this reason from one particle to another particle. To make sure that this works, the powder must admittedly be electrically conductive, as is the case with active carbon.

The sound transducer can be easily used for sound measurement through the mentioned embodiment. Conventional microphones would is be preferable for the most part for this purpose. However, if the above-described sound transducer is anyway present, then the sound transducer can be equipped with the described sensor electrodes and serve for sound measurement with very low expense. The above-described sound pressure sensor can be replaced, if necessary also supplemented, thereby. The invention will be described in more detail in the following with the aid of exemplary embodiments, wherein:

FIG. 1 shows a simplified schematic representation of a membrane 1 of a sound transducer having a housing 2, which contains a layer of adsorbent granulate, for example, active carbon, on whose surface air or gas molecules are adsorbed. Air or gas molecules are present in region A, the adsorption takes place in area B, and this adsorption decreases in region C.

Figure 2:
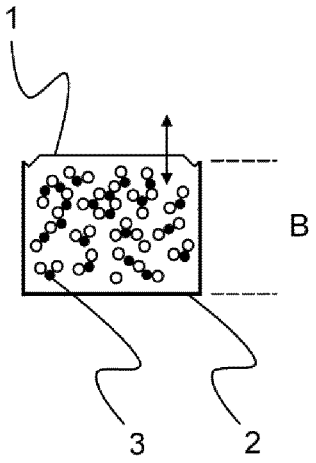
PRIOR ART Fig. 2
FIG. 2 shows a simplified schematic representation of the housing with active carbon powder.

FIG. 2 shows a simplified schematic representation of the housing according to the invention with active carbon powder, consisting of a moisture-tight combination of a membrane 1 and a housing 2, which is filled exclusively with unbound active carbon particles 3 with measurements of clearly less than 0.1 mm, which are freely movable within the entire housing. The area B with adsorption extends to a larger part of the housing 2 as a result of the movement of the particles stimulated by the sound pressure.

Figure 3:
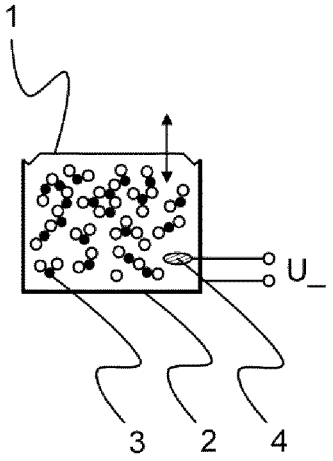
FIG. 3 shows a simplified schematic representation of the housing with active carbon powder, in which a metallic sensor electrode is placed.

FIG. 3 shows a simplified schematic representation of the housing according to the invention with active carbon powder, in which is placed a metallic sensor electrode 4, which produces a to magnitude that is proportional to the sound field in the housing 2 and is fed back to the vibratory drive of the membrane 1 through a signal processing unit.

The starting point is an acoustic system shown in FIG. 1, which consists is of a membrane 1, for example, a loudspeaker membrane, which serves as a sheet-like structure configured to vibrate. The membrane 1 is part of a housing 2. The membrane 1 and the housing 2 are moisture tight. It should be ensured at the same time that the connection between the membrane 1 and the rest of the housing 2 is moisture tight. If an electrodynamic conical loudspeaker is used, this can be achieved, for example, with plastic membranes or metallized plastic membranes, wherein the loudspeaker can be inversely mounted, that is, with the open side of the cone in direction of the housing. The design height of the structure of the loudspeaker and housing 2 that is enlarged therewith is indeed undesirable, but acceptable, in particular in small loudspeakers with flat cone and similar drive systems. A minimum moisture content of the environmental air is to be furthermore ensured during assembly. Air and gas molecules are present in area A, the adsorption of these molecules takes place in area B, and this adsorption decreases in area C, since the molecules of area A rarely reach there.

According to this, the technical approach is based on the use of active carbon powder, whose dominating volume percentage consists of active carbon particles with a size that is clearly less than 100 micrometers. This size is connected to a mass per particle, in which the weight of the particles is more and more within the order of magnitude of the area force acting on the particles as a result of the sound pressure.

As reference point should be mentioned a sound pressure level higher than about 50 dB. It should be emphasized that this value is difficult to determine and is to be considered only as a reference point. Such small active carbon particles start to move induced by sound pressure. The adsorption of the gas or air molecules therefore no longer takes is place only on the statically available surface of the active carbon. The at first glance inconspicuous step toward smaller active carbon particles has surprising consequences. The acoustic compliance with respect to the filling can be quadrupled in small transducers and housings already with an approx. 50 percent housing filling of this type. In a Helmholtz resonator or a loudspeaker housing this means a halving of the resonance frequency without enlarging the housing. The rule publicized until now that the more active carbon in a housing the better is thus at least relativized. It must read more precisely, the greater the dynamically offered surface of the active carbon particles the better, since the adsorption effect is thus reinforced. The surface effect adsorption is superimposed with a dynamic volume effect and reinforced through the reduction of the active carbon particles in the housing 2 filled with sound.

This is shown in FIG. 2. The active carbon particles 3 are swirled by the sound pressure in the housing 2, which is generated by movements of the membrane 1. The active carbon particles 3 are thus swirled within the housing 2. The area B, in which the air molecules are located and where they are adsorbed on the active carbon particles, increases for this reason. It should be noted regarding the representation of FIG. 2 that it is only to be understood as a schematic representation. It is in no way necessary, as mentioned, for the powder to be distributed over the entire housing. Such a to distribution is in fact not detrimental to the function.

The unexpectedly pronounced acoustic advantage of the dynamic of the adsorption process achieved in this way is thereby illustrated. This dynamic can also be illustrated in another way. A metallic electrode 4 is placed for this purpose in a housing 2 filled with such fine active carbon powder 3 and prepolarized with low direct voltage, as can be seen in FIG. 3. An alternating voltage proportional to the sound pressure is adjusted at this electrode 4 as soon as the loudspeaker now generates sound vibrations, that is, the membrane 1 vibrates. The electrode 4 functions as a microphone together with the moving active carbon particles.

This effect is reminiscent of the previously used microphones, even though simple carbon granulated material or granulated carbon was used there. This trial also suggests that the loose, freely movable active carbon powder 3 has a negative effect if it comes in contact with the membrane 1. Extensive experiments however document that this effect could not be detected. The increased acoustic compliance of the housing volume 2 is displayed even with an inverted housing 2, that is, if the active carbon powder 3 rests on the membrane 1.

The prepolarized electrode offers at the same time a functional expansion possibility in the housing, which is used in somewhat modified form, for example, in DE 19746645. The alternating voltage at the electrode, which is proportional to the sound pressure in the housing 2, corresponds in principle to the signal of a microphone at the same point. The simple metal electrode is however irregularly more immune from the active carbon powder. The alternating voltage can be fed back to a vibratory drive of the membrane 1 through a signal processing unit. The sign, amplitude and frequency response of the signal processing unit determine, for example, if the vibratory drive stimulates the membrane 1 more intensively (negative sign) and more weakly (positive sign). A simple possibility of spectrally influencing the acoustic compliance of the housing is thus obtained.

The invention claimed is:

1. An acoustic system comprising a housing, which encloses a volume and in which at least a surface or a sub-surface is formed by a sheet-like structure configured to vibrate, wherein powder made of adsorbent material having an adsorption effective surface is present in the volume, wherein the powder is selected such that, through a movement of the powder caused by vibrations of the sheet-like structure configured to vibrate, the adsorption effective surface is enlarged, wherein the adsorbent material is selected such that an adsorption of air or gas present in the volume is caused by an increase of the pressure caused from vibrations of the sheet-like structure configured to vibrate, wherein the powder is freely movable within the whole housing.

2. The acoustic system according to claim 1, wherein active carbon is selected as adsorbent material.

3. The acoustic system according to claim 1, wherein powder is selected, in which a mass fraction of at least 50% of the powder with a grain size of less than 0.08 mm is present.

4. The acoustic system according to claim 3, wherein a mass fraction of at least 50% of the powder has a grain size of less than 0.05 mm is present.

5. The acoustic system according to claim 3, wherein a mass fraction of at least 50% of the powder has a grain size of less than 0.045 mm is present.

6. The acoustic system according to claim 1, wherein carbon nanotubes are selected as adsorbent material.

7. The acoustic system according to claim 1, wherein the sheet-like structure configured to vibrate is a membrane.

8. The acoustic system according to claim 7, wherein the membrane is a plastic membrane.

9. The acoustic system according to claim 1, wherein a drive unit, with which the sheet-like structure can be stimulated to vibrate, is outside of the housing.

10. The acoustic system according to claim 1, wherein a drive unit is present, with which the sheet-like structure can be stimulated to vibrate, wherein the drive unit is immune from the powder present in the housing.

11. The acoustic system according to claim 1, wherein the housing is moisture tight.

12. The acoustic system according to claim 1, wherein more than half of the housing volume is filled with powder.

13. The acoustic system according to claim 1, wherein a sound pressure sensor is present in the housing.

14. The acoustic system according to claim 13, wherein the sound pressure sensor is a microphone.

15. The acoustic system according to claim 1, wherein a sensor electrode is arranged in the housing such that the arrangement of sensor electrode, powder, and housing forms an electric circuit, whose resistance is modifiable through a density change of the powder, such that through a measurement of the change of the resistance, a statement about the sound that effects a movement of the powder is possible.

16. The acoustic system according to claim 1, wherein the housing is a housing of a sound transducer.

* * * * *